US009268267B2

(12) United States Patent
Matsumoto

(10) Patent No.: US 9,268,267 B2
(45) Date of Patent: Feb. 23, 2016

(54) FUSING APPARATUS AND IMAGE FORMING APPARATUS

(75) Inventor: Hiroshi Matsumoto, Tokyo (JP)

(73) Assignee: KONICA MINOLTA BUSINESS TECHNOLOGIES, INC., Tokyo (JP)

( * ) Notice: Subject to any disclaimer, the term of this patent is extended or adjusted under 35 U.S.C. 154(b) by 33 days.

(21) Appl. No.: 13/450,588

(22) Filed: Apr. 19, 2012

(65) Prior Publication Data

US 2012/0275813 A1 Nov. 1, 2012

(30) Foreign Application Priority Data

Apr. 28, 2011 (JP) ..... 2011-100667

(51) Int. Cl.
*G03G 15/20* (2006.01)

(52) U.S. Cl.
CPC ..... *G03G 15/2028* (2013.01)

(58) Field of Classification Search
CPC ..... G03G 15/2028; G03G 15/2085
USPC ..... 399/69, 323
See application file for complete search history.

(56) References Cited

U.S. PATENT DOCUMENTS 6,015,342 A * 1/2000 Dennis ..... 454/316
2011/0033214 A1* 2/2011 Funabiki et al. ..... 399/323
2011/0085814 A1* 4/2011 Akashi ..... 399/69
2011/0142480 A1* 6/2011 Miyata et al. ..... 399/92
2011/0211875 A1* 9/2011 Takeshita et al. ..... 399/323

FOREIGN PATENT DOCUMENTS

| | | |
|---|---|---|
| JP | 03-164777 | 7/1991 |
| JP | 2003-066762 | 3/2003 |
| JP | 2006-119430 | 5/2006 |
| JP | 2007-206153 | 8/2007 |
| JP | 2007-240921 | 9/2007 |
| JP | 2007-328161 | 12/2007 |

OTHER PUBLICATIONS

Japanese Office Action for Patent Application 2011-100667, Dispatch Date: May 28, 2013.
English translation of Japanese Office Action for Patent Application 2011-100667, Dispatch Date: May 28, 2013.
Japanese Office Action, Application No. 2011-100667, Dispatch Date: Apr. 1, 2014 (5 pages).
English translation of Japanese Office Action, Application No. 2011-100667, Dispatch Date: Apr. 1, 2014 (9 pages).

* cited by examiner

*Primary Examiner* — Ryan Walsh
*Assistant Examiner* — Philip Marcus T Fadul
(74) *Attorney, Agent, or Firm* — Lucas & Mercanti, LLP

(57) ABSTRACT

A fusing apparatus includes a fusing section, a supplying section and a control section. The supplying section supplies airflow between a recording medium and the fusing section. The supplying section includes a supplying opening of the airflow divided in a plurality of blocks along a width direction of the recording medium. The control section controls at least any one of speed of the airflow and supply amount of the airflow individually for each of the plurality of blocks based on information regarding the recording medium.

10 Claims, 9 Drawing Sheets

*FIG. 6*

| | | DEGREE OF SMOOTHNESS [sec] | | |
|---|---|---|---|---|
| | | up to 50 | 51−100 | 101 or more |
| BASIS WEIGHT [g/m$^2$] | up to 100 | 15m/s | 18m/s | 20m/s |
| | 100−135 | 10m/s | 13m/s | 15m/s |
| | 136−176 | 5m/s | 8m/s | 10m/s |
| | 177 or more | 0m/s | 0m/s | 0m/s |

FUSING APPARATUS AND IMAGE FORMING APPARATUS

CROSS REFERENCE TO RELATED APPLICATION

This Application claims the priority of Japanese Patent Application No. 2011-100667 filed on Apr. 28, 2011, the contents of which are incorporated herein by reference.

BACKGROUND

1. Field of the Invention

The present invention relates to a fusing apparatus and an image forming apparatus.

2. Description of Related Art

Conventionally, there is a fusing apparatus which heats and applies pressure while nipping a sheet on which a toner image is formed to fuse a toner image which is not yet fused on the sheet. In such fusing apparatus, the sheet nipped by the fusing apparatus may stick to the fusing apparatus after fusing. As described in, for example, Japanese Patent Application Laid-Open Publication No. H3-164777, there is a fusing apparatus including an air blasting apparatus which sends an airflow between the sheet and the fusing apparatus to separate the sheet from the fusing apparatus. Such blasting apparatus is provided to be able to separate from the fusing apparatus a sheet with the largest size in the width direction orthogonal to the conveying direction of the sheet among the sheet used in image forming. In other words, the range of air blasting of the air blasting apparatus corresponds to the sheet with the largest size in the width direction.

However, the conventional air blasting apparatus blasts air in a range corresponding to the sheet with the largest size in the width direction regardless of the size in the width direction of the sheet orthogonal to the conveying direction of the sheet. Therefore, air is blasted to a range unnecessary for separating the sheet, and needless energy is consumed.

When an image is formed on a sheet with a size in the width direction smaller than the sheet with the largest size in the width direction, the portion of the fusing apparatus positioned outside the edge section of the sheet in the width direction is cooled by directly receiving all of the air from the air blasting apparatus. Therefore, after an image is formed on a sheet with a size in the width direction smaller than the sheet with the largest size in the width direction, when an image is formed on a sheet with a larger size in the width direction, the cooled portion of the fusing apparatus is used to form the image and the fusing apparatus needs to be heated again before fusing processing starts. In other words, blasting air in a range unnecessary for separating the sheet unnecessarily cools the fusing apparatus and the fusing apparatus needs to be heated again. Therefore, the energy efficiency becomes even worse.

SUMMARY

The present invention has been made in consideration of the above problems, and it is one of main objects to provide a fusing apparatus and an image forming apparatus with better energy efficiency.

In order to achieve at least one of the above-described objects, according to an aspect of the present invention, there is provided a fusing apparatus including:

a fusing section including a nipping section which conveys a recording medium while fusing a toner image which is not fused formed on the recording medium by applying pressure and heat on the recording medium heated by a heating section;

a supplying section which is provided on a downstream side of a conveying direction of the recording medium with respect to the nipping section and which supplies airflow between the recording medium conveyed by the nipping section and the fusing section; and a control section which controls operation of the supplying section, wherein the supplying section includes a supplying opening of the airflow divided in a plurality of blocks along a width direction of the recording medium orthogonal to the conveying direction; and the control section controls at least any one of speed of the airflow and supply amount of the airflow individually for each of the plurality of blocks based on information regarding the recording medium.

Preferably, the fusing apparatus further includes a detecting section which individually detects temperature of each portion of the fusing section corresponding to each of the plurality of blocks, wherein the control section controls at least any one of the speed of the airflow and the supply amount of the airflow individually for each of the plurality of blocks based on the temperature of each portion of the fusing section detected by the detecting section.

Preferably, in the fusing apparatus, the control section supplies the airflow from the supplying opening of the block corresponding to the portion detected to be a predetermined temperature or more from the temperature of each portion of the fusing section detected by the detecting section.

Preferably, in the fusing apparatus, the information regarding the recording medium includes information showing at least any one of size in the width direction of the recording medium, weight for each unit area of the recording medium and type of the recording medium.

Preferably, in the fusing apparatus, the supplying section further includes:

an airflow generating section which generates the airflow individually for each of the plurality of blocks; and a duct provided individually for each of the airflow generating section, wherein the control section controls at least any one of the speed of the airflow and the supply amount of the airflow for each of the airflow generating section according to the size in the width direction of the recording medium.

Preferably, the fusing apparatus further includes a changing section which changes a direction of the airflow supplied from the supplying opening along the width direction, wherein the control section controls the changing section to change the direction of the airflow supplied from the supplying opening along the width direction according to the size in the width direction of the recording medium.

Preferably, in the fusing apparatus, the control section supplies the airflow from the supplying opening of the block corresponding to the portion detected to be a predetermined temperature or more among the temperature of each portion of the fusing section detected by the detecting section after fusing processing on the recording medium by the fusing section ends.

BRIEF DESCRIPTION OF THE DRAWINGS

The present invention will become more fully understood from the detailed description given hereinbelow and the appended drawings, and thus are not intended to define the limits of the present invention, and wherein;

FIG. 6 is a diagram showing an example of data associating a combination pattern of a combination of basis weight of a sheet and degree of smoothness of an image forming face of a sheet with a flow rate of the airflow corresponding to each combination pattern;

DETAILED DESCRIPTION OF PREFERRED EMBODIMENTS

Below, an image forming apparatus 1 of an embodiment of the present invention is described in detail with reference to the drawings. The embodiment is one example of the present invention and is not limited to the above.

Figure 1:
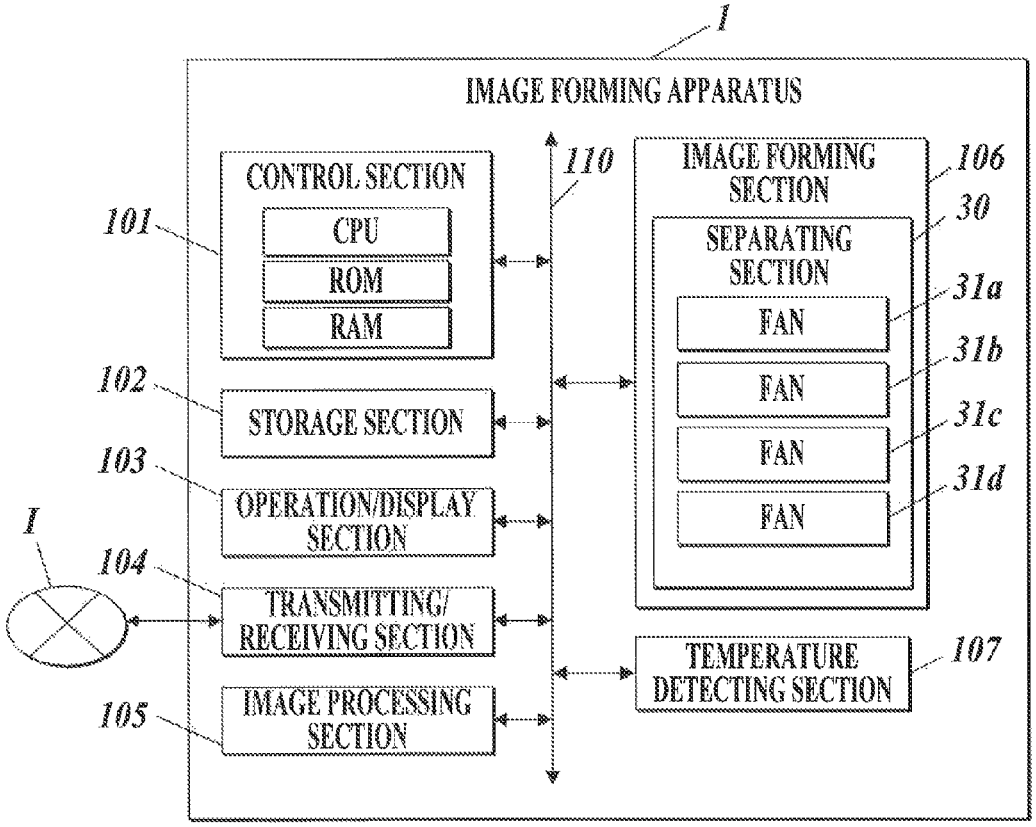
FIG. 1 is a block diagram showing a schematic configuration of an image forming apparatus according to an embodiment of the present invention.

FIG. 1 is a block diagram showing a schematic configuration of an image forming apparatus 1 of an embodiment of the present invention.

For example, as described in FIG. 1, the image forming apparatus 1 includes a control section 101, a storage section 102, an operation/display section 103, a transmitting/receiving section 104, an image processing section 105, an image forming section 106, a temperature detecting section 107 and the like, and each section is connected to each other by a bus 110.

The control section 101 is composed from a CPU (Central Processing Unit), a ROM (Read Only Memory), a RAM (Random Access Memory), and the like. The CPU of the control section 101 reads out a system program and various processing programs stored in the ROM and expands the programs to the RAM. According to the expanded program, the CPU of the control section 101 centrally controls the operation of each section of the image forming apparatus 1.

The storage section 102 is composed of, for example a flash memory, etc. and stores various programs, data, etc. used by each section of the image forming apparatus 1.

The operation/display section 103 includes a display apparatus (not shown) such as an LCD (Liquid Crystal Display), etc. and displays operation status of each function, etc. based on a display signal output from the control section 101. The display screen of the LCD is covered by for example, a touch panel (not shown) of a pressure sensitive type (resistive type) configured by placing a transparent electrode in a grid like shape. The touch panel detects XY coordinates of a power point pressed by a finger, a touch pen, etc. as a pressure value and outputs the detected position signal as an operation signal to the control section 101. The operation/display section 103 includes various operation buttons (not shown) such as numeric buttons, start button, etc., and the operation signal by the button operation is output to the control section 101.

The transmitting/receiving section 104 includes, for example a communication circuit, etc. (not shown) and performs control of communication of information with external equipment connected through a communication network I by a predetermined communication standard such as a wired LAN (Local Area Network), wireless LAN, etc.

Specifically, the transmitting/receiving section 104 receives a print job, etc. transmitted through the communication network I from the external equipment.

The communication network I is a communication network I configured using, for example, a dedicated line or using an existing general public line and various line forms such as LAN, WAN (Wide Area Network), etc. can be applied. The communication network I includes, various communication line networks such as a telephone line network, an ISDN (Integrated Services Digital Network) line network, a dedicated line, a mobile communication network, a communication satellite network, a CATV line network, etc. and an internet service provider which connects the above.

The transmitting/receiving section 104 can connect the external equipment with the image forming apparatus 1 through a connection such as a predetermined interface (for example, USB: Universal Serial Bus).

The image processing section 105 performs image processing such as predetermined color conversion processing (for example, YMCK data generating processing) on the image data (for example, image data, etc. included in the print job received by the transmitting/receiving section 104), γ correction processing of YMCK data, halftone processing and the like, and outputs the image data (print, data) on which image processing is performed to the image forming section 106.

The image forming section 106 forms an image on the recording medium (for example, a sheet P, etc.) based on the print data output from the image processing section 105.

The image forming section 106 of the present embodiment is a configuration (tandem type) which transfers each of four colors such as yellow (Y), magenta (M), cyan (C), black (K) using individual electrostatic drums.

Figure 2:
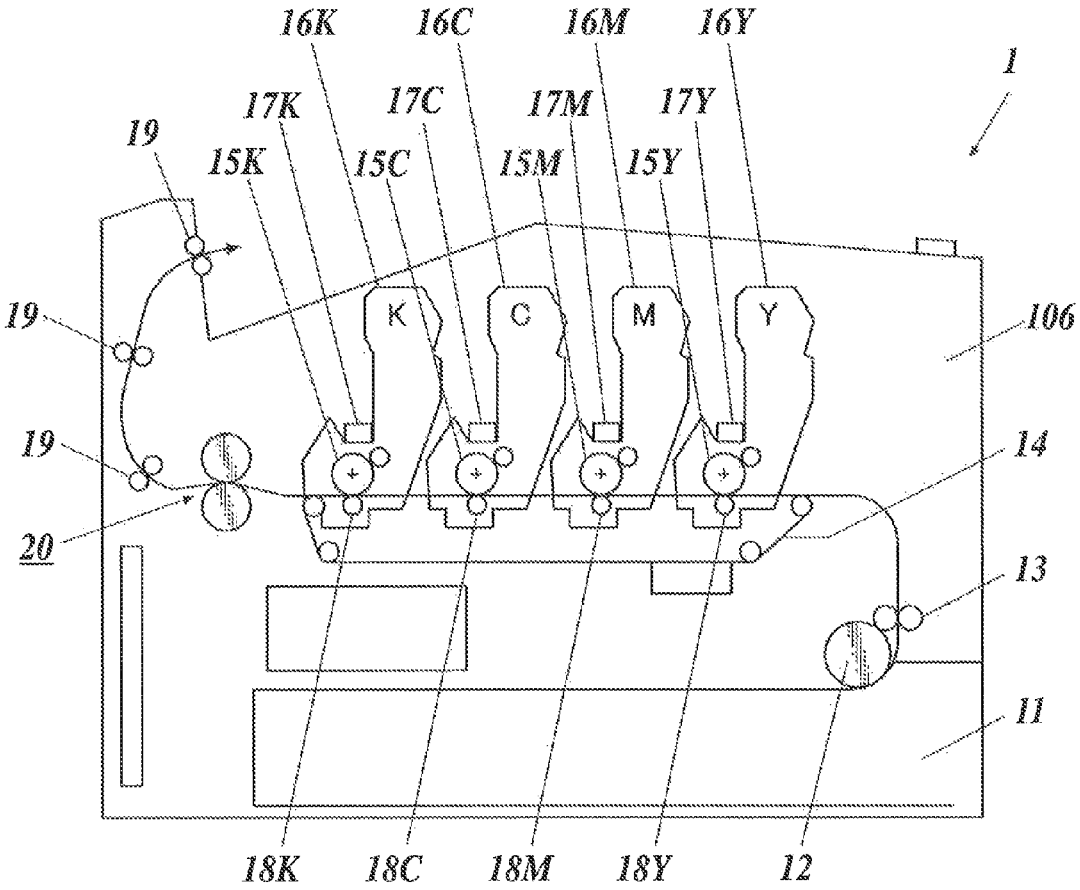
FIG. 2 is a diagram showing a main configuration of an image forming section.

FIG. 2 is a diagram showing a main configuration of an image forming section 106.

As shown in FIG. 2, the image forming section 106 includes a cassette 11, a sheet feeding roller 12, a conveying roller 13, a conveying belt 14, electrostatic drums 15Y, 15M, 15C and 15K, print units 16Y, 16M, 16C and 16K, laser units 17Y, 17M, 17C and 17K, transfer rollers 18Y, 18M, 18C and 18K, fusing section 20, sheet ejecting roller 19, and the like.

The cassette 11 stores a sheet P.

The sheet feeding roller 12 pulls out the sheet P stored in the cassette 11 one sheet at a time.

The conveying roller 13 conveys the sheet P pulled out by the sheet feeding roller 12 and conveys the sheet to the conveying belt 14.

The conveying belt 14 transfers the toner image to the sheet P in coordination with the electrostatic drums 15Y, 15M, 15C and 15K.

Here, the transfer of the toner image is described using the transfer of the toner image of yellow (Y) by the electrostatic drum 15Y as an example.

The electrostatic drum 15Y is a member in a cylinder shape driven to rotate by a driving section (not shown) and the outer peripheral surface of the cylinder is charged by a charging unit (not shown). The laser unit 17Y forms an electrostatic latent image on the outer peripheral surface of the electrostatic drum 15Y. Specifically, the laser unit 17Y emits a laser according to the image of yellow formed on the sheet P based on the print data on the outer peripheral surface of the charged electrostatic drum 15Y.

The print unit 16Y forms a toner image of yellow (Y) on the outer peripheral surface of the electrostatic drum 15Y.

Specifically, the print unit 16Y includes a toner cartridge and a developing unit. The toner cartridge stores toner of yellow (Y) and supplies the toner to the developing unit. The developing unit performs developing processing and applies toner of the toner cartridge on the electrostatic latent image formed on the outer peripheral surface of the electrostatic drum 15Y. With the developing processing, the toner image of yellow (Y) is formed on the outer peripheral surface of the electrostatic drum 15Y.

The transfer roller 18Y transfers the toner image of yellow (Y) formed on the outer peripheral surface of the electrostatic drum 15Y onto the sheet P.

The transfer roller 18Y is provided in a position facing the electrostatic drum 15Y with the conveying belt 14 in between. The transfer roller 18Y charges the sheet P with a charge opposite of the toner image at a timing when the sheet P is nipped between the conveying belt 14 and the electrostatic drum 15Y (opposite charging processing). With the opposite charging processing, the toner image of yellow (Y) formed on the outer peripheral surface of the electrostatic drum 15Y is transferred on the sheet P.

Similar to the mechanism of transfer of the toner image of yellow (Y) by the above electrostatic drum 15Y, the electrostatic drum 15M transfers the toner image of magenta (M), the electrostatic drum 15C transfers the toner image of cyan (C) and the electrostatic drum 15K transfers the toner image of black (K). At this point, a toner image which is not fused is formed on the sheet P based on the print data.

The conveying belt 14 conveys the sheet P on which toner images of the four colors are overlapped and transferred to the fusing section 20.

The fusing section 20 fuses the toner image transferred on the sheet P. The details of the fusing section 20 are described later.

The sheet ejecting roller 19 conveys the sheet P on which the toner image is fused by the fusing section 20 and ejects the sheet on the sheet ejecting tray.

Figure 3:
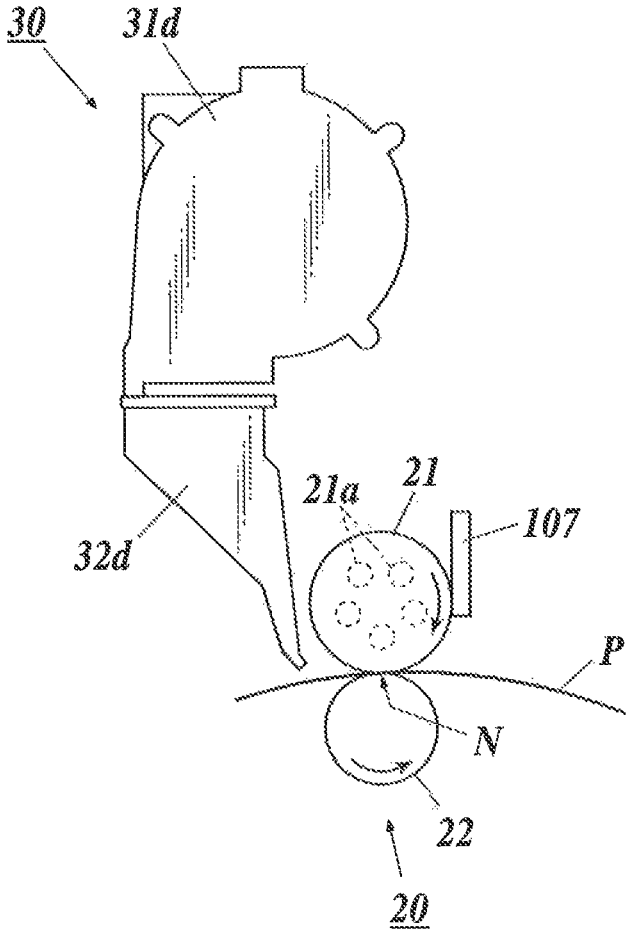
FIG. 3 is a diagram showing an example of a configuration of a fusing section of an image fusing apparatus, a separating section and a temperature detecting section.

FIG. 3 is a diagram showing an example of a configuration of a fusing section 20 of an image fusing apparatus, a separating section 30 and a temperature detecting section 107.

Figure 4:
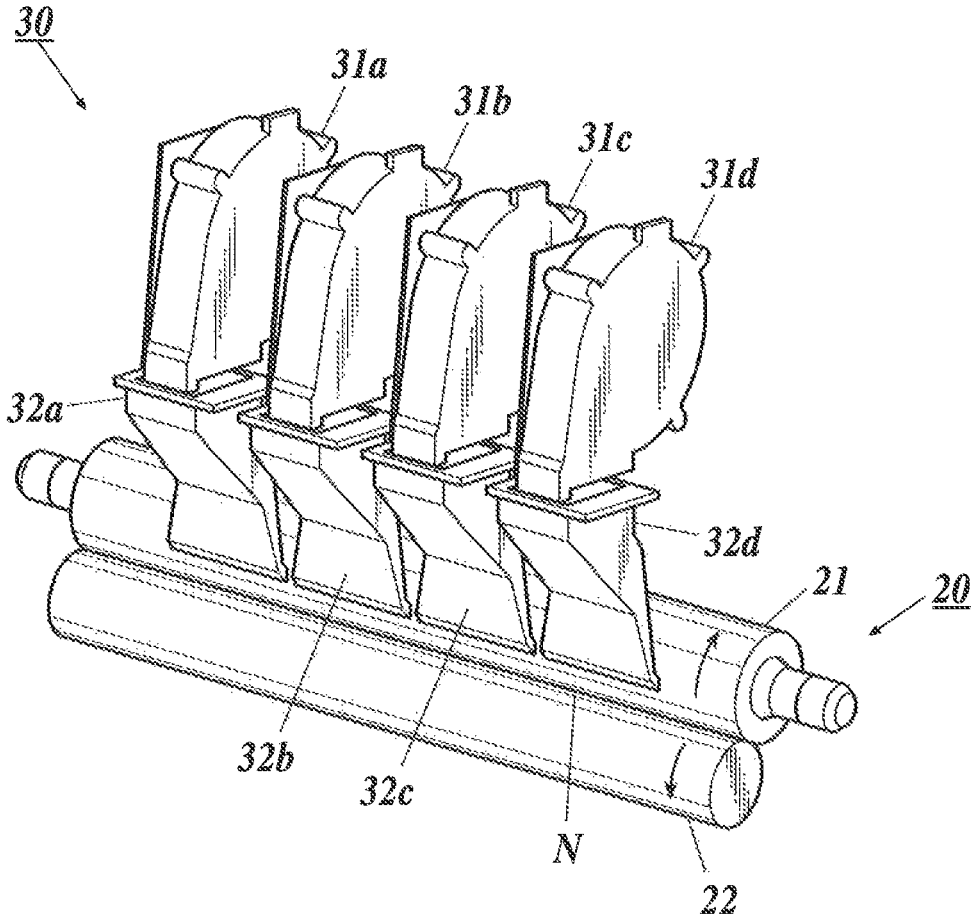
FIG. 4 is a diagram showing a perspective view of a fusing section and a separating section shown in FIG. 3.

FIG. 4 is a perspective diagram of the fusing section 20 and the separating section 30 shown in FIG. 3.

The fusing section 20 includes a heating roller 21 and a pressurizing roller 22.

The heating roller 21 and the pressurizing roller 22 operate in coordination with each other to form a pressure welding section (nipping section N) with the outer peripheral surface of the heating roller 21 and the outer peripheral surface of the pressurizing roller 22. The pressurizing roller 22 driven by the driving section (not shown) and the heating roller 21 rotating in contact with the pressurizing roller 22 nips the sheet P with the nipping section N, applies pressure and heat and performs the fusing processing on the sheet P. The heating roller 21 and the pressurizing roller 22 perform the fusing processing on the sheet P with the nipping section N while conveying the sheet P in a predetermined direction (for example, left side of the nipping section N in FIG. 3).

The heating roller 21 is heated by the heating section (for example, heating section 21*a* provided on the inner side of the heating roller 21 shown in FIG. 3). For example, the heating section 21*a* is a conductor provided on the inner side of the heating roller 21 and functions as a heater which produces heat by electric resistance when an electric current is flown and heats the heating roller 21 from the inner side. The outer peripheral surface of the heating roller 21 is covered by, for example, a resin (silicon rubber, etc.) including predetermined heat resistance and the resin transmits the heat applied from the inner side to the outer peripheral surface to transmit the heat to the sheet P which passes through nipping section N.

The heating roller 21 and the pressurizing roller 22 perform fusing processing on the sheet P in the nipping section N, convey the sheet P on which fusing processing is performed to eject the sheet P to the downstream side of the conveying direction.

Below, the descriptions of "upstream side" or "downstream side" are descriptions based on the conveying direction of the sheet P.

A separating section 30 is provided on a downstream side of the nipping section N, and supplies airflow between a sheet conveyed (ejected) by the nipping section N and the heating roller 21. The sheet P which receives the airflow by the separating section 30 is biased downward from the heating roller 21 and is guided to separate from the heating roller 21.

According to the present embodiment, the separating section 30 supplies airflow by driving the fans 31*a*, 31*b*, 31*c* and 31*d*, however this is one example, and the configuration is not limited to the above. For example, a jet flow of compressed air caused by a compressor, etc. can be supplied.

As shown in FIG. 4, the separating section 30 of the present embodiment includes a plurality of fans 31*a*, 31*b*, 31*c* and 31*d* and ducts 32*a*, 32*b*, 32*c* and 32*d* provided along an axis direction of the heating roller 21. Here, the axis direction of the heating roller 21 is along a width direction of a recording medium (sheet P) orthogonal to the conveying direction of the recording medium. In other words, the fans 31*a*, 31*b*, 31*c* and 31*d* and the ducts 32*a*, 32*b*, 32*c* and 32*d* of the separating section 30 are provided along the width direction of the recording medium.

The fans 31*a*, 31*b*, 31*c* and 31*d* are each driven to cause airflow to supply the airflow to the ducts 32*a*, 32*b*, 32*c* and 32*d*.

The ducts 32*a*, 32*b*, 32*c* and 32*d* each guide the airflow supplied from the fans 31*a*, 31*b*, 31*c* and 31*d* between the sheet, which is conveyed (ejected) from the nipping section N and attached to the heating roller 21, and the heating roller 21. The plurality of ducts 32*a*, 32*b*, 32*c* and 32*d* provided along the width direction of the recording medium function together as a supplying opening of the airflow along the width direction of the recording medium (sheet P). Each of the plurality of ducts 32*a*, 32*b*, 32*c* and 32*d* correspond to one block of the supplying opening of the airflow divided to a plurality of blocks along the width direction of the recording medium.

The temperature detecting section 107 individually detects temperature of each portion of the fusing section (for example, the heating roller 21 of the fusing section 20) corresponding to each of the plurality of blocks.

Specifically, the temperature detecting section 107 includes, for example, a plurality of thermistors and each thermistor is provided near each portion of the heating roller 21 corresponding to each of the plurality of blocks divided by the plurality of ducts 32*a*, 32*b*, 32*c* and 32*d*. Each of the thermistors changes the electrical resistance value according to the change in temperature near each portion of the heating roller 21. Based on the electrical resistance value of each of the thermistors, the temperature detecting section 107 detects the temperature of each portion of the heating roller 21 corresponding to each of the plurality of blocks and outputs information showing the detected temperature. The control section 101 obtains the temperature of each portion of the heating roller 21 with the information showing the temperature output from the temperature detecting section 107.

The control section 101 controls at least any one of speed of airflow and supply amount of airflow individually for each of the plurality of blocks based on information regarding a recording medium (sheet P).

Specifically, for example, the control section 101 controls the supply amount of airflow individually for each of the plurality of blocks according to the size in the width direction of the sheet P.

The storage section 102 stores data to identify type of size (for example, type of size based on dimensions, etc. standardized A series, B series, etc.) of sheet P used in forming the image and size of width direction of sheet P, which changes according to the direction of the sheet P, orthogonal to the conveying direction. Specifically, for example, the storage section 102 stores table data associating the combination pattern of setting of the size and direction of the sheet P which may be used in forming an image with the size in the width direction of the sheet P in each combination pattern.

The storage section 102 stores data which identifies which of the plurality of fans 31*a*, 31*b*, 31*c* and 31*d* is operated according to the size in the width direction of the sheet P.

The control section 101 obtains the setting of the size and the direction of the sheet P used in forming the image. Specifically, for example, the control section 101 obtains the setting of the size and the direction of the sheet P instructed by input from the user through the operation/display section 103, etc. The control section 101 can store the obtained setting as data in the storage section 102.

When the control section 101 obtains the setting of the size and the direction of the sheet P used in forming the image, the control section 101 identifies the size in the width direction of the sheet P corresponding to the obtained combination of the size and the direction of the sheet P based on the data stored in the storage section 102 and further identifies the fan to be operated according to the identified size in the width direction. Then, the control section 101 operates the fan identified as the fan to be operated among the plurality of fans 31*a*, 31*b*, 31*c* and 31*d* when the fusing processing is performed on the sheet P by the fusing section 20.

Figure 5A:
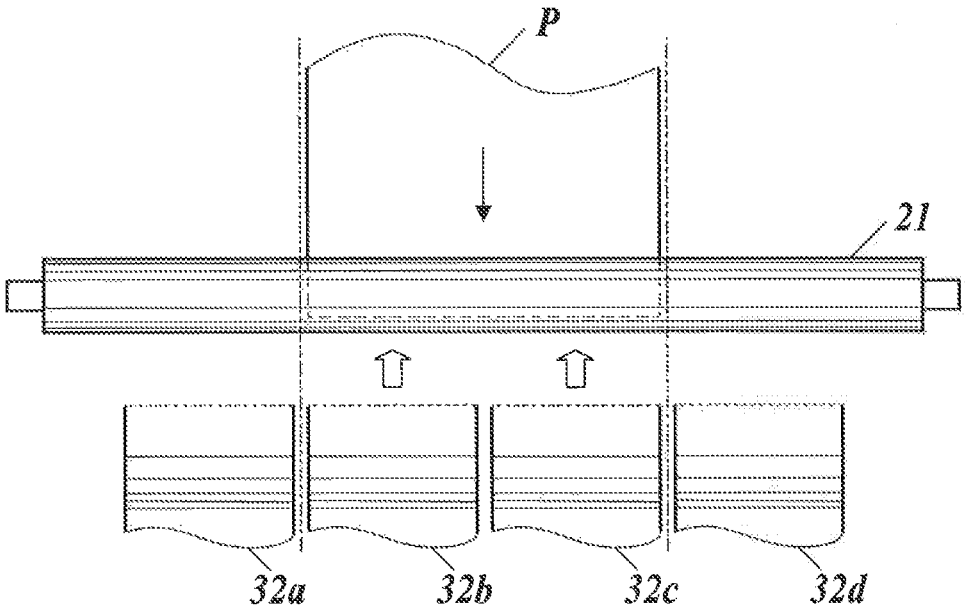
FIG. 5A is a diagram showing an example of fans 31*b* and 31*c* operating and fans 31*a* and 31*d* not operating.
Figure 5B:
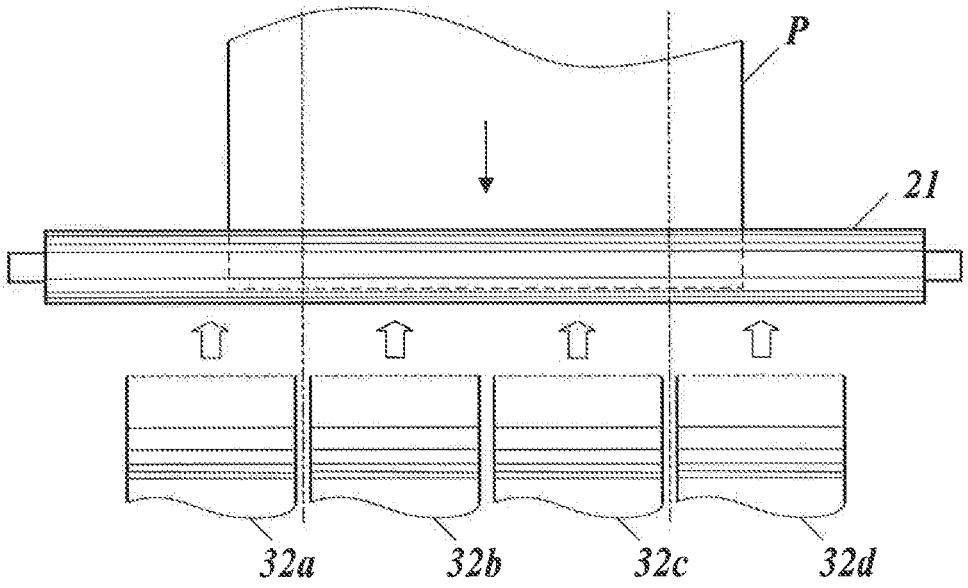
FIG. 5B is a diagram showing an example of fans 31*a*, 31*b*, 31*c* and 31*d* operating.

FIG. 5A and FIG. 5B are diagrams showing an example of airflow supplied according to the size in the width direction of the sheet P. FIG. 5A shows an example in which fans 31*b* and 31*c* are operated and fans 31*a* and 31*d* are not operated. FIG. 5B shows an example in which fans 31*a*, 31*b*, 31*c* and 31*d* are operated.

For example, the setting of the data is set so that when the size in the width direction of the sheet P is a predetermined size (for example, 210 [mm]) or less, only the fans 31*b* and 31*c* are operated, and when the size is larger than the predetermined size, the fans 31*a*, 31*b*, 31*c* and 31*d* are operated. In an image forming apparatus 1 with such setting, when the setting of the sheet used in forming the image is vertical A4 (the longitudinal direction of the sheet P is the direction along the conveying direction) or the size in the width direction of the sheet P is set to a sheet with a size in the width direction smaller than vertical A4, the control section 101 operates the fans 31*b* and 31*c* and does not operate the fans 31*a* and 31*d* as shown in FIG. 5A. When the size in the width direction of the sheet P is set to a sheet larger than the size in the width direction of vertical A4, the control section 101 operates the fans 31*a*, 31*b*, 31*c* and 31*d* as shown in FIG. 5B.

The control section 101 controls the speed of the airflow (flow rate) based on the information regarding the sheet P.

FIG. 6 is a diagram showing an example of data associating a combination pattern of basis weight of sheet P and degree of smoothness of an image forming face of the sheet P with the flow rate ([m/s]) of the airflow corresponding to each combination. The degree of smoothness shown in FIG. 6 is a result of measurement by a Bekk smoothness testing apparatus of Kumagai Riki Kogyo Co., Ltd.

For example, as shown in FIG. 6, the storage section 102 stores data associating the combination pattern of the basis weight of the sheet P and the degree of smoothness of the image forming face of the sheet P with the flow rate of the airflow corresponding to each combination pattern. In the example shown in FIG. 6, the data shows that as the basis weight of the sheet P becomes smaller, the air volume becomes larger and as the degree of smoothness of the image forming face of the sheet P becomes smaller, the air volume becomes larger. The data is provided so that airflow with a larger flow rate is supplied to a sheet with an attribute (basis weight or degree of smoothness of image forming face) showing a tendency to attach to the heating roller 21.

The control section 101 obtains the basis weight of the sheet P and the degree of smoothness of the image forming face of the sheet P used in forming the image. Specifically, for example, the control section 101 obtains the setting regarding the basis weight of the sheet P and the degree of smoothness of the image forming face of the sheet P instructed by input from the user through the operation/display section 103, etc. For example, the setting is input as specification of type (normal sheet, glossy sheet, etc.) of the sheet. The control section 101 can store the obtained setting as data in the storage section 102.

The control section 101 identifies the basis weight of the sheet P and the degree of smoothness of the image forming face of the sheet P based on the specified type of sheet and the data stored in advance in the storage section 102, etc. which associates the type of sheet, basis weight of the sheet P and the degree of smoothness of the image forming face of the sheet P to each other. Then, the control section 101 identifies the flow rate of the airflow corresponding to the combination pattern combining the identified basis weight of the sheet P and the degree of smoothness of the image forming face of the sheet P. Then, the control section 101 operates the fans so that among the plurality of fans 31*a*, 31*b*, 31*c* and 31*d*, the airflow by operation of the fan identified as the fan to be operated is to be the identified flow rate when the fusing processing is performed on the sheet P.

The control section 101 controls at least any one of the speed of airflow and the supply amount of airflow individually for each of the plurality of blocks based on the temperature of each portion of the fusing section (for example, heating roller 21 of the fusing section 20) detected by the detecting section (for example, temperature detecting section 107).

Specifically, for example, the control section 101 controls the supply amount of airflow individually for each of the plurality of blocks according to temperature of each portion of the heating roller 21 detected by the temperature detecting section 107.

Figure 7:
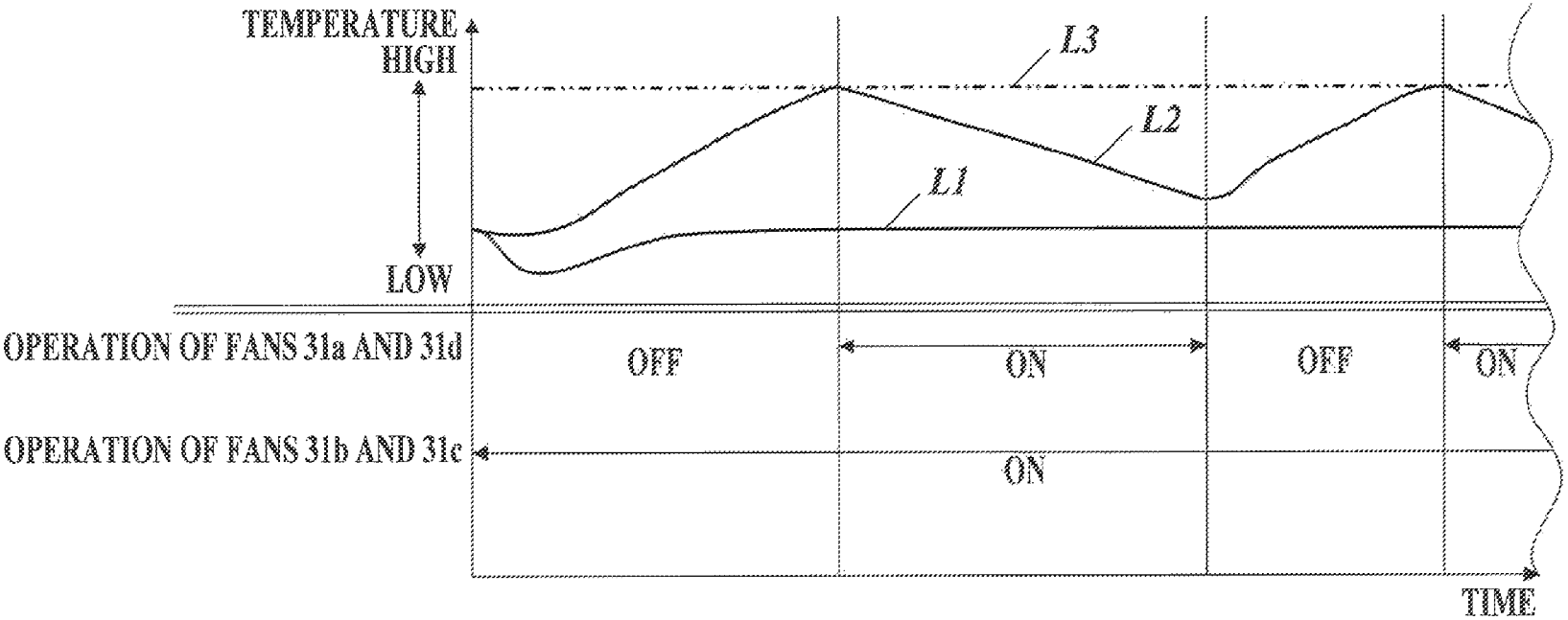
FIG. 7 is a diagram showing an example of a corresponding relation between temperature of each portion of a heating roller and each operation (ON/OFF) of a plurality of fans.

FIG. 7 is a diagram showing an example of a corresponding relation between the temperature of each portion of the heating roller 21 and operation (ON/OFF) of each of the plurality of fans 31*a*, 31*b*, 31*c* and 31*d*.

Figure 8:
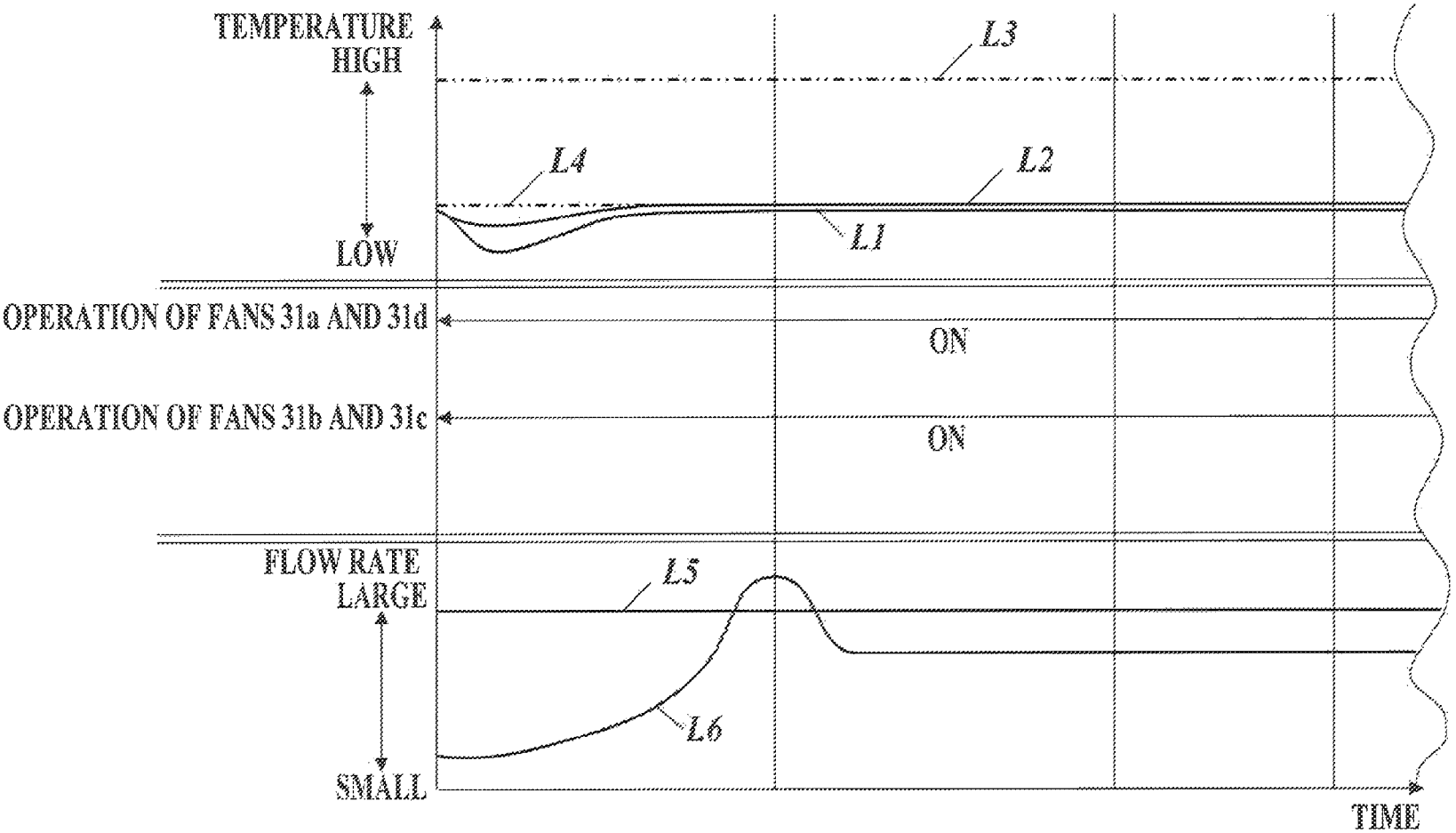
FIG. 8 is a diagram showing an example of a corresponding relation between temperature of each portion of a heating roller and flow rate of each of the plurality of fans.

In the example shown in FIG. 7 and the later described FIG. 8, the setting of the sheet P is vertical A4. In FIG. 7 and FIG. 8, the change in temperature of the portion of the heating roller 21 which is in contact with the sheet P is represented by line L1 and the change in temperature of the portion of the heating roller 21 which is not in contact with the sheet P is represented by line L2.

As shown in FIG. 7, an upper limit temperature L3 of the heating roller 21 is set in the image forming apparatus 1 of the present embodiment. The upper limit temperature L3 is a temperature determined in advance to prevent unevenness of temperature of the heating roller 21 and to prevent damage, reduction of lifespan of the component, etc. due to overheating by the heating roller 21. The data showing the upper limit temperature L3 is stored in, for example, the ROM of the control section 101, storage section 102 or the like.

In the fusing processing, some of the heat is deprived by the sheet P from the portion of the heating roller 21 which is in contact with the sheet P. The portion of the heating roller 21 which is not in contact with the sheet P is not deprived of heat by the sheet P. Therefore, the portion of the heating roller 21 which is not in contact with the sheet P is in a state having more heat than the portion of the heating roller 21 which is in contact with the sheet P. If this state continues, the heat of the portion of the heating roller 21 which is not in contact with the sheet P may become too large and may reach the upper limit temperature L3 or more. Therefore, the control section 101 operates the fan of the block corresponding to the portion of the heating roller 21 where the temperature detected by the temperature detecting section 107 becomes the upper limit temperature L3 or more (including the upper limit temperature L3).

For example, the control section 101 operates the fan (for example, fans 31*b* and 31*d*) identified as the fan to be operated based on the information regarding the sheet after starting the forming of the image. Then, as the image forming continues and the temperature of the portion of the heating roller 21 corresponding to the block of the fans 31*a* and 31*d* rises, the control section 101 operates the fans 31*a* and 31*d* in addition to the fans 31*b* and 31*c*. When the fans 31*a* and 31*d* are operated, airflow is provided to the portion of the heating roller 21 detected to be the upper limit temperature L3 or more and the airflow deprives heat from the heating roller 21 to lower the temperature of the portion. With this, the heating roller 21 can be maintained to a temperature of the upper limit temperature L3 or lower.

In other words, the control section 101 supplies airflow from the supplying opening of the block corresponding to the portion detected to be a predetermined temperature (for example, upper limit temperature L3) or more.

The above control of supply amount of airflow and flow rate of airflow is one example and is not limited to the above. For example, in addition to the upper limit temperature L3, a predetermined temperature where it is not necessary to cool any further (lower limit temperature) can be provided, and the control section 101 can control at least any one of the supply amount of airflow and the flow rate of airflow to be smaller in a block corresponding to a portion of the heating roller 21 where the temperature detected by the temperature detecting section 107 is the lower limit temperature or lower.

The operation control pattern of the fans 31*a*, 31*b*, 31*c* and 31*d* to set the supply amount of airflow and the flow rate of airflow so as not to cause temperature unevenness in the heating roller 21 can be individually provided by measurement, etc. in advance for each of the plurality of pieces of recording medium (sheet P) in which at least one of the size in the width direction, basis weight, type etc. is different regarding the recording medium and the operation control pattern can be stored in the storage section 102, etc. Then, the control section 101 can read out the operation control pattern according to the setting of the sheet P instructed by the user and control the operation of the fans 31*a*, 31*b*, 31*c* and 31*d*.

The image forming apparatus 1 of the present embodiment includes, a supplying section (for example, separating section 30) which is provided on a downstream side of a recording medium (sheet P) with respect to a nipping section N and which supplies an airflow between the recording medium conveyed by the nipping section N and a fixing section; and a control section (for example, control section 101) which controls operation of the supplying section. The supplying section includes supplying openings (for example, ducts 32*a*, 32*b*, 32*c* and 32*d*, etc.) of airflow divided to a plurality of blocks along the width direction of the recording medium orthogonal to the conveying direction. The control section controls at least any one of the speed of airflow and the supply amount of airflow individually for each of the plurality of blocks based on the information regarding the recording medium (for example, data showing size in the width direction of the sheet P used in the image forming). Therefore, the speed of airflow and the supply amount of airflow of each of the plurality of blocks can be changed according to the recording medium. In other words, it is possible to prevent consumption of energy to supply airflow to a block which does not need supply of airflow. Moreover, unnecessary cooling of the fusing section 20 can be prevented and reheating of the heating roller 21 which compensates for the unnecessary cooling is not necessary. Consequently a fusing apparatus and an image forming apparatus with better energy efficiency can be provided.

In addition, by using a control pattern of airflow for each block to set the supply amount of airflow and flow rate of airflow so as not to cause temperature unevenness in the heating roller 21, both preventing temperature unevenness in the width direction of the heating roller 21 and controlling energy efficient airflow can be realized.

The image forming apparatus 1 includes a detecting section (for example, temperature detecting section 107) which individually detects the temperature of each portion of the fusing section (for example, heating roller 21 of the fusing section 20) corresponding to each of the plurality of blocks. The control section (for example, control section 101) controls at least any one of the speed of airflow and the supply amount of airflow individually for each of the plurality of blocks based on the temperature of each portion of the fusing section detected by the detecting section. Therefore, by increasing the flow rate of airflow and the supply amount of airflow of the block corresponding to the portion in which the temperature of the heating roller 21 increases, the portion in which the temperature increases can be cooled and the temperature can be evened in the width direction of the heating roller 21. The unevenness of temperature (temperature unevenness) may cause unevenness of gloss of the image formed on the sheet P or wrinkles in the sheet. Therefore, by preventing the temperature unevenness to even the temperature, the quality of print output can be maintained in a high state.

The control section (for example, the control section 101) supplies airflow from the supplying opening of the block corresponding to the portion detected to have a predetermined temperature (for example, upper limit temperature L3) or more among the temperature of each portion of the fusing section (for example, heating roller 21 of heating section 20)

detected by the detecting section (for example, temperature detecting section 107). Therefore, the portion of the heating roller 21 with a predetermined temperature or more can be cooled with the airflow and it is possible to prevent damage, reduction of lifespan of component, etc. due to overheating of a portion of the heating roller 21.

The information regarding the recording medium (sheet P) includes information showing at least any one of size of width direction of the recording medium, weight for each unit area of the recording medium and type of recording medium. Therefore, the supply amount of airflow or flow rate of airflow for each of the plurality of blocks can be set to a speed of airflow or supply amount of airflow necessary to separate the recording medium from the fusing section 20. Therefore, supplying airflow to a block in which supply of airflow is not necessary can be prevented and it is possible to provide a fusing apparatus and an image forming apparatus with better energy efficiency.

Although various exemplary embodiments have been shown and described, the invention is not limited to the embodiments shown. Therefore, the scope of the invention is intended to be limited solely by the scope of the claims that follow and not by the above explanation, and it is intended that the present invention covers modifications and variations that come within the scope of the appended claims and their equivalents.

For example, the control section 101 can control the flow rate of airflow individually for each of the plurality of blocks according to temperature of each portion of the heating roller 21 detected by the temperature detecting section 107. In this case, for example, the control section 101 controls the flow rate for each of the plurality of fans 31*a*, 31*b*, 31*c* and 31*d* in order to maintain the temperature of the outer peripheral surface of the heating roller 21 to a predetermined temperature lower than the upper limit temperature L3 (for example, maintaining target temperature L4).

FIG. 8 is a diagram showing an example of a corresponding relation between the temperature of each portion of the heating roller 21 and the flow rate of each of the plurality of fans 31*a*, 31*b*, 31*c* and 31*d*.

For example, the control section 101 operates the fan (for example, fans 31*b* and 31*d*) identified as the fan to be operated based on the information regarding the sheet after starting the forming of the image.

Specifically, for example, the control section 101 operates the fan, at a predetermined flow rate identified based on the basis weight of the sheet P and the degree of smoothness of the image forming face of the sheet P as shown in line L5 of FIG. 8.

In the portion of the heating roller 21 corresponding to the portion of the nipping section N which is in contact with the sheet P, in other words, the width direction of the sheet P, the temperature of the outer peripheral surface of the heating roller 21 is lowered by the heat transferring from the outer peripheral surface of the heating roller 21 to the sheet P. The heat is deprived by the cooling by the airflow at a predetermined flow rate identified based on the basis weight of the sheet P and the degree of smoothness of the image forming face of the sheet P and therefore the temperature (temperature represented by line L1 of FIG. 8) of the portion of the heating roller 21 corresponding to the width direction of the sheet P is maintained at about the maintaining target temperature L4.

In the portion of the heating roller 21 corresponding to the portion of the nipping section N which is not in contact with the sheet P, the heat is not transmitted to the sheet P, and therefore, the temperature rises and exceeds the maintaining target temperature L4 with the same cooling condition as the portion of the nipping section N which is in contact with the sheet P. Therefore, the control section 101 operates the fan (for example fans 31*a* and 31*d*) of the block corresponding to the portion of the nipping section N which is not in contact with the sheet P and supplies the airflow to the portion of the nipping section N which is not in contact with the sheet P to cool the portion of the nipping section N which is not in contact with the sheet P. The control section 101 controls the flow rate of the fan (for example, fans 31*a* and 31*d*) of the block corresponding to the portion of the nipping section N which is not in contact with the sheet P in order to maintain the temperature of the outer peripheral surface of the heating roller 21 to the maintaining target temperature L4 based on the temperature of each portion of the heating roller 21 detected by the temperature detecting section 107. Specifically, for example, the control section 101 controls the flow rate of the airflow according to the temperature (temperature represented by line L2 of FIG. 8) of the portion of the heating roller 21 which is not in contact with the sheet P detected by the temperature detecting section 107 as shown in line L6 of FIG. 8. In other words, the control section 101 controls the flow rate of the airflow caused by the fan corresponding to each block to adjust the degree of cooling according to the detected temperature of the heating roller 21.

With this, the flow rate of the airflow of the block corresponding to the portion where the temperature of the heating roller 21 rises is increased so that the portion where the temperature rises can be cooled and the temperature can be made even in the width direction of the heating roller 21.

Regarding the direction of the airflow supplied by the supplying opening (for example, ducts 32*a* and 32*d*), a changing section (for example, air direction changing plate 35) which changes the direction along the width direction of the recording medium (sheet P) can be provided to enable the control section 101 to use the changing section to change the direction of the airflow along the width direction supplied by the supplying opening according to the size in the width direction of the recording medium.

Figure 9A:
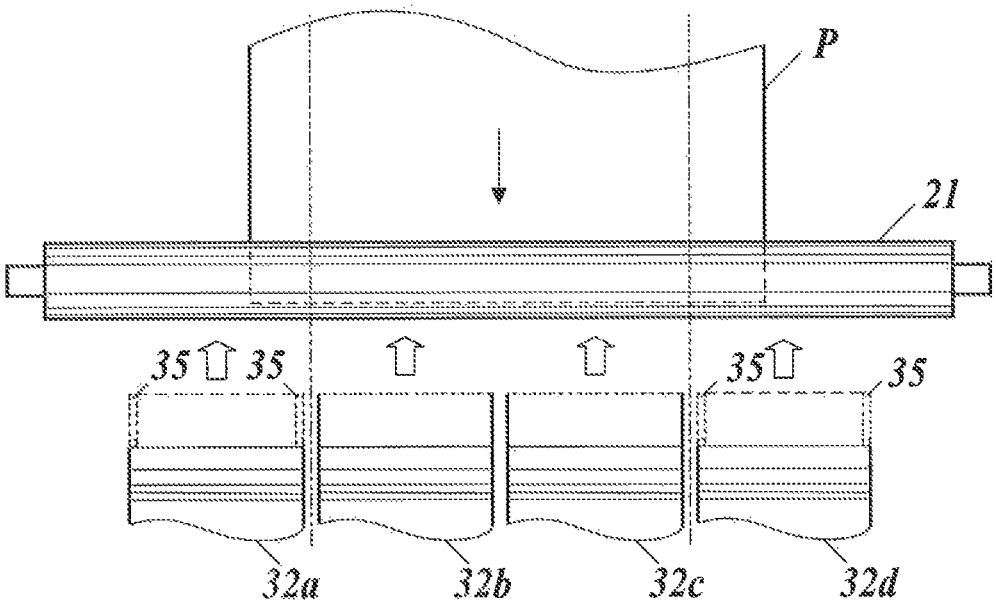
FIG. 9A is an image diagram of an air direction by an air direction changing plate in an angle orthogonal to the axis direction of the heating roller.
Figure 9B:
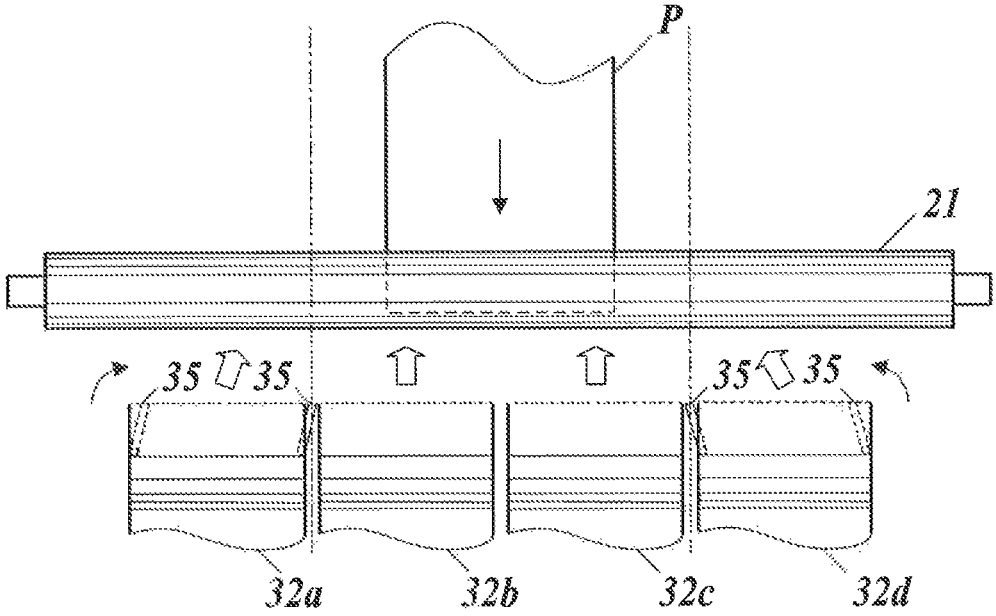
FIG. 9B is an image diagram of an air direction by an air direction changing plate in an angle tilted toward the center side of the axis direction of the heating roller.

FIG. 9A and FIG. 9B are diagrams showing an example of change of direction of the airflow by the air direction changing plate 35 provided in each of the ducts 32*a* and 32*d*. FIG. 9A is an image diagram of an air direction by the air direction changing plate 35 when the angle is orthogonal to the axis direction of the heating roller 21. FIG. 9B is an image diagram of an air direction by the air direction changing plate 35 in an angle tilted toward the center side of the axis direction of the heating roller 21.

For example, as shown in FIG. 9A and FIG. 9B, the air direction changing plate 35 is provided on both ends of the axis direction of the ducts 32*a* and 32*d*. The air direction changing plate 35 is provided at both ends of the direction along the axis direction of the heating roller 21 of the airflow ejecting opening of the ducts 32*a* and 32*d*. The air direction changing plate 35 is a member in a plate shape including a planar surface section provided to be able to sway between at least an angle orthogonal to the axis direction of the heating roller 21 and the angle tilting in a predetermined angle toward the center side of the axis direction of the heating roller 21.

As shown in FIG. 9A, when the air direction changing plate 35 is in an angle orthogonal to the axis direction of the heating roller 21, the airflow supplied through the ducts 32*a* and 32*d* is supplied along the direction substantially orthogonal to the axis direction of the heating roller 21. As shown in FIG. 9B, when the air direction changing plate 35 is in an angle tilted to the center side of the axis direction of the heating roller 21, the airflow supplied through the ducts 32*a* and 32*d* is supplied to the center side of the axis direction of the heating roller 21.

For example, when the setting of the sheet used in forming the image is vertical A4 (the longitudinal direction of the sheet P is a direction along the conveying direction) or when the size in the width direction of the sheet P is set to a sheet smaller than the size in the width direction of vertical A4, the control section 101 operates the fans 31*b* and 31*c* and further, as shown in FIG. 9B, the control section 101 controls the air direction changing plate 35 to be in an angle tilted to the center side of the axis direction of the heating roller 21 to set the direction of airflow of the fans 31*a* and 31*d* to the center side of the axis direction of the heating roller and operates the fans 31*a* and 31*d*. When the size in the width direction of the sheet P is set to a sheet larger than the size in the width direction of vertical A4, as shown in FIG. 9A, the control section 101 controls the air direction changing plate 35 to be in an angle orthogonal to the axis direction of the heating roller 21 and operates the fans 31*a*, 31*b*, 31*c* and 31*d*. According to the above control, when the control of the direction of the airflow is not used, the airflow of the fans not used according to the size in the width direction of the sheet P (for example, fans 31*a* and 31*d*) can be used for separating a smaller sheet P with the airflow.

The control of the air direction by the air direction changing plate 35 described using FIG. 9A and FIG. 9B is one example and is not limited to the above. For example, a configuration to change the air direction can be provided on the inner side of the supplying opening of the duct. The method of changing the air direction is not limited to the center side of the axis direction of the heating roller 21 and can be changed to any direction along the width direction.

After the fusing processing on the recording medium (sheet P) by the fusing section 20 ends, the control section 101 can supply airflow from the supplying opening of the block corresponding to the portion detected to be a predetermined temperature (for example, upper limit temperature L3) or more among the temperature of each portion along the width direction of the heating roller 21 of the fusing section 20 detected by the detecting section (for example, temperature detecting section 107). According to the above control, the heating roller 21 is not left in a state with a predetermined temperature (for example, upper limit temperature L3) or more after the fusing processing ends, and the heating roller 21 is cooled with the airflow. Consequently, it is possible to prevent damage, reduction of lifespan of component, etc. of the heating roller 21 due to overheating.

The control section 101 can control at least any one of the speed of airflow and the supply amount of airflow individually for each of the plurality of airflow generating sections (for example, plurality of fans 31*a*, 31*b*, 31*c*, 31*d*, etc.) according to the size in the width direction of the recording medium (sheet P).

For example, when one of the portions of the heating roller 21 corresponding to one of the plurality of blocks is in contact with the sheet P in the whole range of the width direction of the sheet P, one of the portions is deprived of heat by the sheet P evenly, and therefore, temperature unevenness does not occur. Therefore, in this case, the control section 101 controls the flow rate of the fan of the block corresponding to the portion based on the data associating the combination pattern of the basis weight of the sheet and the degree of smoothness of the image forming face of the sheet with the flow rate of the airflow corresponding to each of the combination pattern as shown in FIG. 6.

When one of the portions of the heating roller 21 corresponding to one of the plurality of blocks is in contact with the sheet P in a range of a predetermined percentage which is not the entire width direction of the sheet P, the range which is in contact with the sheet P is deprived of heat by the sheet P whereas the range which is not in contact with the sheet P is not deprived of heat in one of the portions of the heating roller 21. Therefore, if there is no cooling, temperature unevenness between the range which is in contact with the sheet P and the range which is not in contact with the sheet P occurs in the heating roller 21. Therefore, in this case, the control section 101 controls the flow rate of the fan of the block corresponding to the portion according to the amount of the predetermined percentage and adjusts the amount of cooling capacity by the airflow.

For example, as the predetermined percentage becomes smaller, the control section 101 controls the supply amount of airflow and the flow rate of airflow from the fan corresponding to the one of the portions of the heating roller 21 to be larger. This is because, as the range which is in contact with the sheet P becomes smaller, the heat deprived of the sheet P becomes smaller and the heat remaining in the heating roller 21 becomes larger, and therefore, larger cooling capacity becomes necessary.

For example, data associating the size in the width direction, of the sheet P with the flow rate of each of the plurality of fans 31*a*, 31*b*, 31*c* and 31*d* is stored in the storage section 102, etc. The control section 101 identifies the size in the width direction from the type of size of the sheet P and the direction of the sheet P used in forming the image. The control section 101 identifies the flow rate of each of the plurality of fans 31*a*, 31*b*, 31*c* and 31*d* from the identified size in the width direction of the sheet P. The control section 101 controls the operation of each of the fan to be the identified flow rate.

When such control is performed, the control section (for example, control section 101) controls at least any one of the speed of airflow and the supply amount of airflow individually for each of the plurality of airflow generating sections (for example, plurality of fans 31*a*, 31*b*, 31*c*, 31*d*, etc.) according to the size in the width direction of the recording medium (sheet P). Consequently, airflow can be supplied according to the cooling capacity necessary for each portion of the heating roller 21 and a fusing apparatus and image forming apparatus with better energy efficiency can be provided. Moreover, the temperature of the heating roller 21 can be even in the width direction of the recording medium.

The control section 101 can obtain change in temperature for each unit of predetermined amount of time regarding the temperature of each portion of the heating roller 21 detected by the temperature detecting section 107, and can control the supply amount of airflow and the flow rate of airflow for each of the plurality of blocks corresponding to each portion based on the obtained change in temperature of each portion.

For example, the storage section 102 stores data associating the type of size of the sheet P and the direction of the sheet P used in forming the image, the span (for example, rise in temperature of 1 to 3 degrees, 4 to 5 degrees, etc.) of change in temperature of the heating roller 21 at a predetermined time interval (for example, 60 seconds), and the flow rate of airflow and the supply amount of airflow. The control section 101 monitors the temperature change of each portion of the heating roller 21 obtained from the temperature detecting section 107 in a unit of a predetermined amount of time, and identifies the flow rate of airflow and supply amount of airflow corresponding to the span of change of temperature within the unit of the monitored predetermined amount of time individually for each portion of the heating roller 21. Then, the control section 101 controls the operation of the fan of the block corresponding to each portion of the heating roller 21 so as to be the identified flow rate of airflow and supply amount of airflow. When the temperature of the heating roller 21 is monitored in a unit of a predetermined amount of time, the control section 101 can control cooling of a portion of the heating roller 21 when the temperature of the portion is a predetermined temperature (for example, upper limit temperature L3) or more without waiting the predetermined amount of time.

The above described embodiment uses four fans 31*a*, 31*b*, 31*c* and 31*d* and four ducts 32*a*, 32*h*, 32*c* and 32*d* corresponding to a plurality of blocks. However, the above is one example and the present invention is not limited to the above. The number of the plurality of blocks, the size in the width direction of each block and the like can be suitably changed. The corresponding relation between the size in the width direction of the recording medium and the control of at least any one of the flow rate of airflow and supply amount of airflow can be suitably changed according to the number of the plurality of blocks and the size in the width direction of each block.

The airflow generating section (for example, fans 31*a*, 31*b*, 31*c* and 31*d*) does not have to be provided individually for each of the supplying opening of airflow divided in a plurality of blocks. For example, when the number of airflow generating sections provided is smaller than the number of supplying openings of airflow divided in a plurality of blocks, the control section 101 controls the supply amount of airflow and the flow rate of airflow supplied from each supplying opening by control of opening and closing the supplying opening, control of width of the opening section of the supplying opening, or similar control.

The nipping section N of the above embodiment is formed by two rollers (heating roller 21 and pressurizing roller 22), however this is one example and the configuration is not limited to the above. For example, one or both of the two rollers can be a belt member supported by a plurality of rollers.

The relation between the information regarding the recording medium (sheet P) and the supply amount and speed of airflow controlled based on information regarding the recording medium as shown in the present embodiment is one example, and is not limited to the above. For example, the speed of airflow can be controlled according to the size in the width direction of the sheet P and the supply amount of airflow can be controlled according to the basis weight or degree of smoothness of the sheet P. The control of the supply amount is not limited to the fan being turned ON/OFF. For example, the degree of opening of the flow path of the airflow, or the like can be controlled. In this case, the supply amount of airflow is controlled by providing a member such as a shutter which opens and closes a portion or the entire supplying opening and a configuration which drives the member (electric motor), and the opening and closing or a portion or the entire supplying opening is switched according to the supply amount of airflow. Similar control can be conceived for the flow rate of airflow.

The information regarding the recording medium (sheet P) is not limited to the size in the width direction of the recording medium, the weight for each unit area of the recording medium and type of recording medium. For example, a sensor or the like which detects the position of the edge section in the width direction of the sheet P used in forming the image and conveyed to the fusing section 20 can be provided, and the control section 101 can identify the relation of the position of the edge section of the sheet P and the duct of each block of the separating section 30 based on the position of the edge section in the width direction of the sheet P detected by the sensor and can control the speed of airflow and supply amount of airflow according to the relation of the position.

The forming of the image in the above embodiment is performed by color print processing which transfers toner images of four colors on a sheet, however, the color print processing is one example of forming the image and the method is not limited to the above. For example, the image forming apparatus 1 can perform black and white print processing which transfers a toner image of only one color for example, black (K)) on a sheet.

The steps of forming an image on a sheet is described, however, the image forming apparatus 1 can form an image on a recording medium other than a sheet by a mechanism similar to forming an image on a sheet.

The image forming section 106 is a configuration which transfers each of the four colors of yellow (Y), magenta (M), cyan (C), and black (K) with individual electrostatic drums (tandem method), however the above configuration is one example and the configuration is not limited to the above. For example, a configuration of transferring by one electrostatic drum is possible.

According to an aspect of the preferred embodiments of the present invention, there is provided a fusing apparatus including:

a fusing section including a nipping section which conveys a recording medium while fusing a toner image which is not fused formed on the recording medium by applying pressure and heat on the recording medium heated by a heating section;

a supplying section which is provided on a downstream side of a conveying direction of the recording medium with respect to the nipping section and which supplies airflow between the recording medium conveyed by the nipping section and the fusing section; and a control section which controls operation of the supplying section, wherein the supplying section includes a supplying opening of the airflow divided in a plurality of blocks along a width direction of the recording medium orthogonal to the conveying direction; and the control section controls at least any one of speed of the airflow and supply amount of the airflow individually for each of the plurality of blocks based on information regarding the recording medium.

According to an aspect of the preferred embodiments of the present invention, there is provided an image forming apparatus including:

an image forming section which forms a toner image which is not fused on a recording medium; and a fusing apparatus.

Consequently, a fusing apparatus and an image forming apparatus with better energy efficiency can be provided.

Preferably, the fusing apparatus further includes a detecting section which individually detects temperature of each portion of the fusing section corresponding to each of the plurality of blocks, wherein the control section controls at least any one of the speed of the airflow and the supply amount of the airflow individually for each of the plurality of blocks based on the temperature of each portion of the fusing section detected by the detecting section.

Preferably, in the fusing apparatus, the control section supplies the airflow from the supplying opening of the block corresponding to the portion detected to be a predetermined temperature or more from the temperature of each portion of the fusing section detected by the detecting section.

Preferably, in the fusing apparatus, the information regarding the recording medium includes information showing at least any one of size in the width direction of the recording medium, weight for each unit area of the recording medium and type of the recording medium.

Preferably, in the fusing apparatus, the supplying section further includes:

an airflow generating section which generates the airflow individually for each of the plurality of blocks; and a duct provided individually for each of the airflow generating section, wherein the control section controls at least any one of the speed of the airflow and the supply amount of the airflow for each of the airflow generating section according to the size in the width direction of the recording medium.

Preferably, the fusing apparatus further includes a changing section which changes a direction of the airflow supplied from the supplying opening along the width direction, wherein the control section controls the changing section to change the direction of the airflow supplied from the supplying opening along the width direction according to the size in the width direction of the recording medium.

Preferably, in the fusing apparatus, the control section supplies the airflow from the supplying opening of the block corresponding to the portion detected to be a predetermined temperature or more among the temperature of each portion of the fusing section detected by the detecting section after fusing processing on the recording medium by the fusing section ends.

The present application is based on Japanese Patent Application No. 2011-100667 filed on Apr. 28, 2011 to the Japanese Patent Office, which shall be a basis for correcting mistranslations.

What is claimed is:

1. A fusing apparatus comprising:

a fusing section including a nipping section which conveys a recording medium while fusing a toner image which is not fused formed on the recording medium by applying pressure and heat on the recording medium heated by a heating section;

a supplying section which is provided on a downstream side of a conveying direction of the recording medium with respect to the nipping section and which supplies airflow between the recording medium conveyed by the nipping section and the fusing section; and a control section which controls operation of the supplying section, wherein the supplying section includes a supplying opening of the airflow divided in a plurality of blocks along a width direction of the recording medium orthogonal to the conveying direction and a changing section which changes a direction of the airflow supplied from the supplying opening along the width direction of the recording medium;

wherein the control section controls the changing section to change the direction of the airflow supplied from the supplying opening along the width direction according to the size in the width direction of the recording medium, and wherein the control section selects a block to supply the airflow based on information regarding a width in a direction orthogonal to the conveying direction of the recording medium, and the control section controls the changing section to change the direction of the airflow of the unselected block and to not change the direction of the airflow of the selected block.

2. The fusing apparatus of claim 1, wherein the fusing apparatus further comprises a plurality of temperature sensors each of which individually detects temperature of each portion of the fusing section corresponding to each of the plurality of blocks;

the control section controls at least any one of speed of the airflow and supply amount of the airflow individually for each of the plurality of blocks based on information regarding the recording medium and the temperature of each portion of the fusing section detected by the temperature sensors, the control section varies the at least any one of speed of the airflow and supply amount of the airflow in correlation to a tendency of the recording medium to attach to the heating roller; and the control section controls, during fusing processing, the supplying section to continuously supply air flow to a first set of blocks of the plurality of blocks corresponding to a size in the width direction of the recording medium based on the information regarding the recording medium, and controls a second set of blocks of the plurality of blocks based on the temperature detected by the temperature sensors, the control section controls the supplying section to not supply the airflow to the second set of blocks when a predetermined temperature or more is not detected, and to supply the airflow to the second set of blocks when a predetermined temperature or more is detected.

3. The fusing apparatus of claim 2, wherein the control section supplies the airflow from the supplying opening of the block corresponding to the portion detected to be a predetermined temperature or more from the temperature of each portion of the fusing section detected by the temperature sensors.

4. The fusing apparatus of claim 3, wherein the control section supplies the airflow from the supplying opening of the block corresponding to the portion detected to be a predetermined temperature or more among the temperature of each portion of the fusing section detected by the temperature sensors after fusing processing on the recording medium by the fusing section ends.

5. The fusing apparatus of claim 2, wherein the information regarding the recording medium includes information showing at least any one of size in the width direction of the recording medium, weight for each unit area of the recording medium and type of the recording medium.

6. The fusing apparatus of claim 2, wherein the supplying section further includes:

an airflow generating section which generates the airflow individually for each of the plurality of blocks; and a duct provided individually for each of the airflow generating section, wherein the control section controls at least any one of the speed of the airflow and the supply amount of the airflow for each of the airflow generating section according to the size in the width direction of the recording medium.

7. The fusing apparatus of claim 2, wherein the control section incrementally varies the at least any one of speed of the airflow and supply amount of the airflow in correlation to the tendency of the recording medium to attach to the heating roller.

8. The fusing apparatus of claim 2, wherein the tendency of the recording medium to attach to the heating roller is determined based on at least one of a basis weight and a degree of smoothness of the recording medium.

9. The fusing apparatus of claim 2, wherein the at least any one of speed of the airflow and supply amount of the airflow is increased as at least one of a basis weight of the recording medium becomes smaller and a degree of smoothness of the recording medium becomes smaller.

10. An image forming apparatus comprising:

an image forming section which forms a toner image which is not fused on a recording medium; and a fusing apparatus of claim 1.

* * * * *